US007987807B2

(12) United States Patent
Mikacich

(10) Patent No.: US 7,987,807 B2
(45) Date of Patent: Aug. 2, 2011

(54) BOAT COVER SUSPENSION DEVICE

(75) Inventor: Coburn J. Mikacich, Orlando, FL (US)

(73) Assignee: Cobe Mik, Inc.,, Orlando, FL (US)

( * ) Notice: Subject to any disclaimer, the term of this patent is extended or adjusted under 35 U.S.C. 154(b) by 125 days.

(21) Appl. No.: 12/506,900

(22) Filed: Jul. 21, 2009

(65) Prior Publication Data

US 2010/0024711 A1 Feb. 4, 2010

Related U.S. Application Data

(60) Provisional application No. 61/135,363, filed on Jul. 21, 2008.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 3,059,659 A * 10/1962 Ipsen ..... 135/87
5,027,739 A * 7/1991 Lackovic ..... 114/361
5,269,332 A * 12/1993 Osborne ..... 135/88.01
7,735,235 B2 * 6/2010 Waddell et al. ..... 33/664

* cited by examiner

*Primary Examiner* — Stephen Avila
(74) *Attorney, Agent, or Firm* — DLA Piper LLP (US)

(57) ABSTRACT

The present invention provides a device for suspending a boat cover from a vertical projection attached to a boat, such that the boat cover is maintained under tension to prevent the formation of pools of water on the cover.

14 Claims, 4 Drawing Sheets

BOAT COVER SUSPENSION DEVICE

CROSS-REFERENCE TO RELATED APPLICATIONS

This application claims the benefit of U.S. Provisional Application No. 61/135,363 filed Jul. 21, 2008.

TECHNICAL FIELD

The present invention relates generally to boats, and more particularly, some embodiments relate to boat covers.

DESCRIPTION OF THE RELATED ART

A boat cover protects an open cockpit or other areas of the boat from potential damage from exposure to the elements while the boat is not in use. In some cases, a flexible boat cover drapes over vertically extending portions of the cockpit, such as the windshield, and is secured to the hull of the boat around the perimeter of the cover to prevent water, sun, and other potentially damaging aspects of the environment from reaching the boat interior.

Without a means of support, the slack in a boat cover allows rainwater to pool on the surface of the boat cover. This can lead to the cover deforming, leaking, ripping, or otherwise being damaged such that the boat is no longer protected. An ill-fitting cover can be destroyed in its first use, for example, if there is a storm or heavy rain. Conventional flexible boat covers are supported by one or more poles that support the cover from within the boat. These poles rest on the deck or hull of the boat and press the boat cover up from the bottom to remove slack. Covering a boat using this type of boat cover requires the user to enter the space created between the boat cover and the boat, which often requires uncomfortable crawling or hunching. The difficulty of manipulating the pole within this space prevents users from properly placing the pole to effectively protect the boat. Furthermore, these poles are susceptible to slipping, for example from non-symmetrical forces placed at the top of the pole by nonsymmetrical cover tension or the weight of small pools of water forming in the cover.

BRIEF SUMMARY OF EMBODIMENTS OF THE INVENTION

According to various embodiments of the invention, a boat cover is suspended from vertical projection arising from the boat such that the boat cover is stably maintained and installation of the cover does not require entering the space between the cover and the boat.

According to an embodiment of the invention, an installable boat cover suspension device comprises an attachment member configured to attach to a portion of a surface of a boat cover; and a tether configured to attach to the attachment member and configured to attach to a vertical projection disposed on a boat; wherein the tether is configured such that, when the device is installed on a boat cover and when the boat cover is secured to a boat, tension is provided to the portion to suspend the portion above a hull of the boat.

According to a further embodiment of the invention, the attachment member comprises a first clamping member configured to be disposed on an exterior side of the portion when installed and a second clamping member configured to be disposed on an interior side of the portion when installed and wherein the attachment member is configured to be installed by securing the first clamping member to the second clamping member with the portion between the first and second clamping members.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

Figure 1:
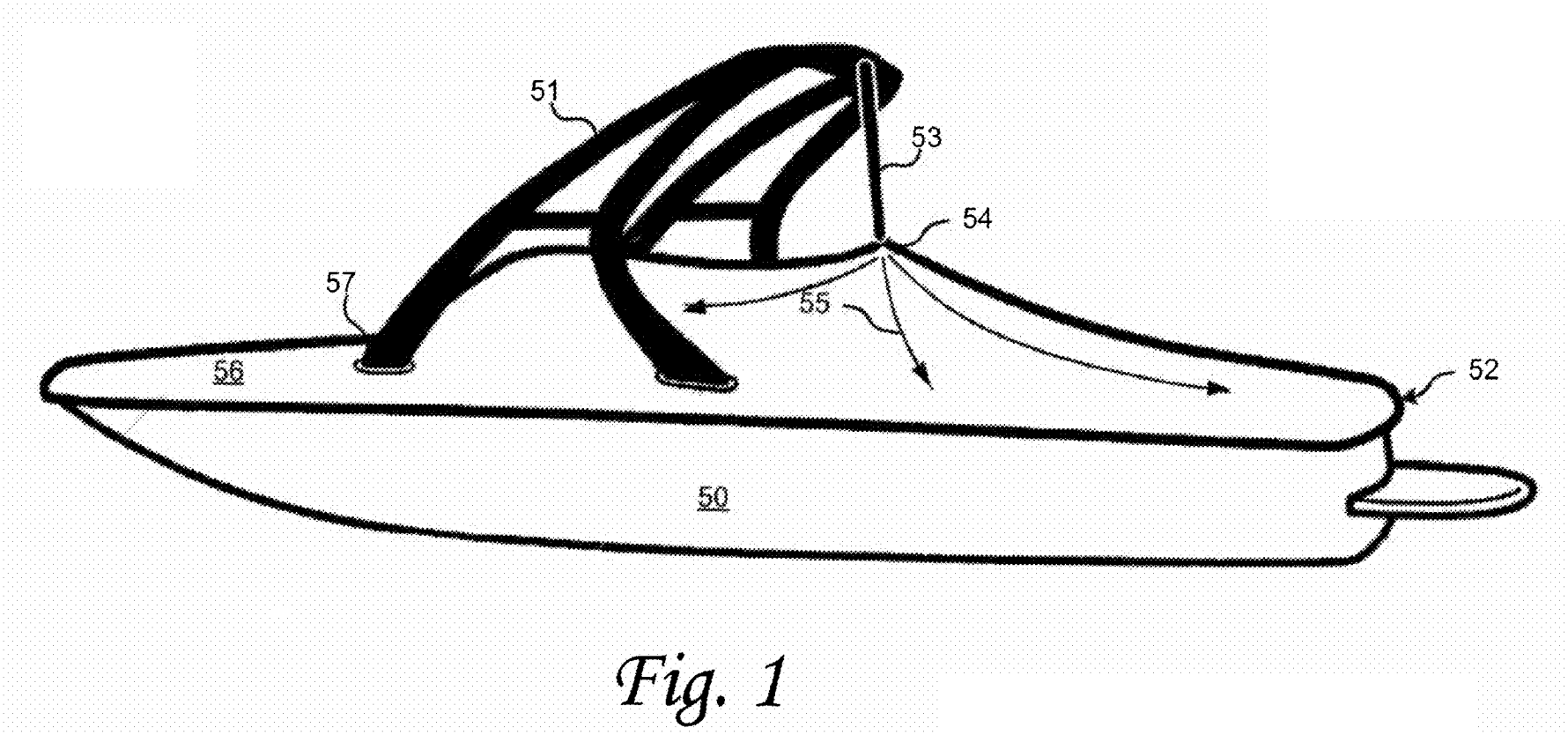
FIG. 1 is a side view of a boat with a boat cover installed according to an embodiment of the invention.
Figure 2:
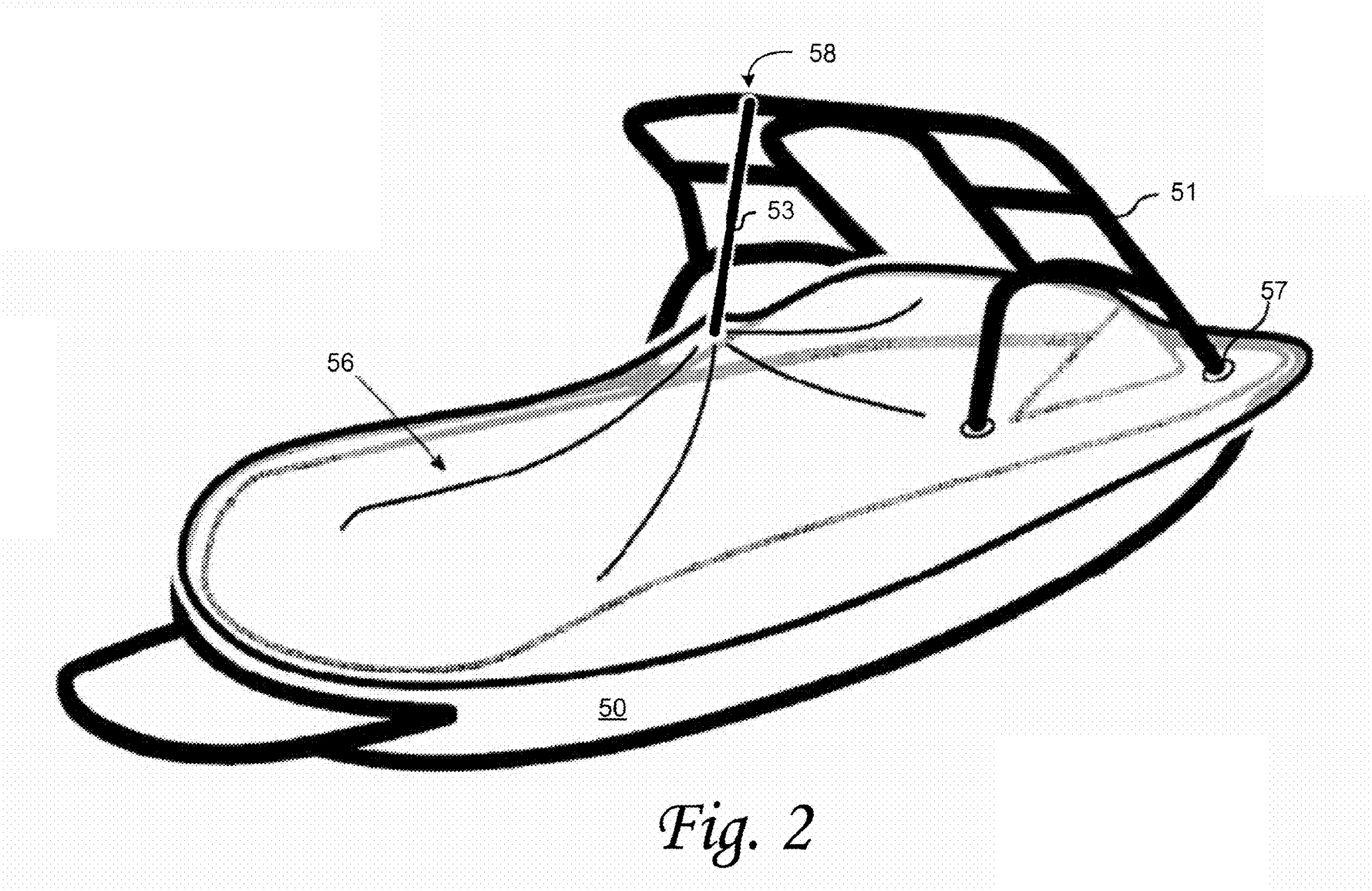
FIG. 2 is a second side view of a boat with a boat cover installed according to an embodiment of the invention.

FIGS. 1 and 2 illustrate side views of a boat with a boat cover installed according to an embodiment of the invention. Many modern boats have elements that vertically project above a boat. For example, a wakeboard tower 51 may be attached to ski boat to allow a line held by a wakeboarder to have a higher attachment point to lower his effective weight, enabling a greater ability to perform aerial maneuvers. Typically, pre-existing boat covers 56 are configured to install around these vertical projections. For example, a boat cover may have a plurality of holes 57 that are disposed around the bases of the wakeboard tower 51, or the perimeter of the boat cover may simply deform around the bases of the tower. Accordingly, the vertical projection 51 is located to the exterior of the boat cover 56 when the boat cover is installed on the boat 50.

In the illustrated embodiment, a tether 53 is attachable to the boat cover 56 at location 54 and to the tower 51. Tether 53 allows boat cover 56 to be suspended above the hull, the cockpit and other open areas of the boat such that rain flows 55 towards the perimeter and off of the boat cover without significant pooling. Because tether 53 is attached to the tower 51 and is therefore exterior to the space created by boat cover 56 and the boat 50, a user may install the boat cover without ever entering the hull of the boat 50. Furthermore, the force on the cover location 54 is aligned with the tether such that the location 54 is pulled the attachment point 58 of tether 53 on the tower 51. In contrast to a system employing a pole means of pushing the cover up from the base of boat 50, the suspension illustrated in FIGS. 1 and 2 results in a more stable configuration because there is no more stable configuration that can be reached without severing the tether. No matter how location 54 is displaced, for example through nonsymmetrical tension on boat cover 56 or forces created by small pools of water, location 54 remains in a stable position. In further embodiments, tether 53 further comprises a means of adjusting the tension placed on cover 56. This may allow a cover 56 to be adapted to fit a greater variety of boat types than would be available by using a typical support device. Additionally, some plastic or permanent deformation of boat cover 56 over time may be unavoidable. For example, small pools of water may slowly deform cover 56, or the effects of age and travel with the boat cover in place may deform the cover. However, by adjusting the tension on tether 53, the effects of these deformations may be mitigated. In further embodiments, attachment point 58 may be adjustable to further allow for compensation for environment-specific deformations and specific manufacturing characteristics.

In some embodiments, boat cover 56 may be manufactured to allow for suspension by tether 53. In these embodiments, means for structurally supporting the cover at location 54 may be created during the manufacturing process. For example, a boat cover may be reinforced, for example through multiple layers of material, at location 54. In other embodiments, a device may be supplied to allow a pre-existing boat cover 56 to be retrofitted to allow it to be suspended from a tether 53.

Figure 3:
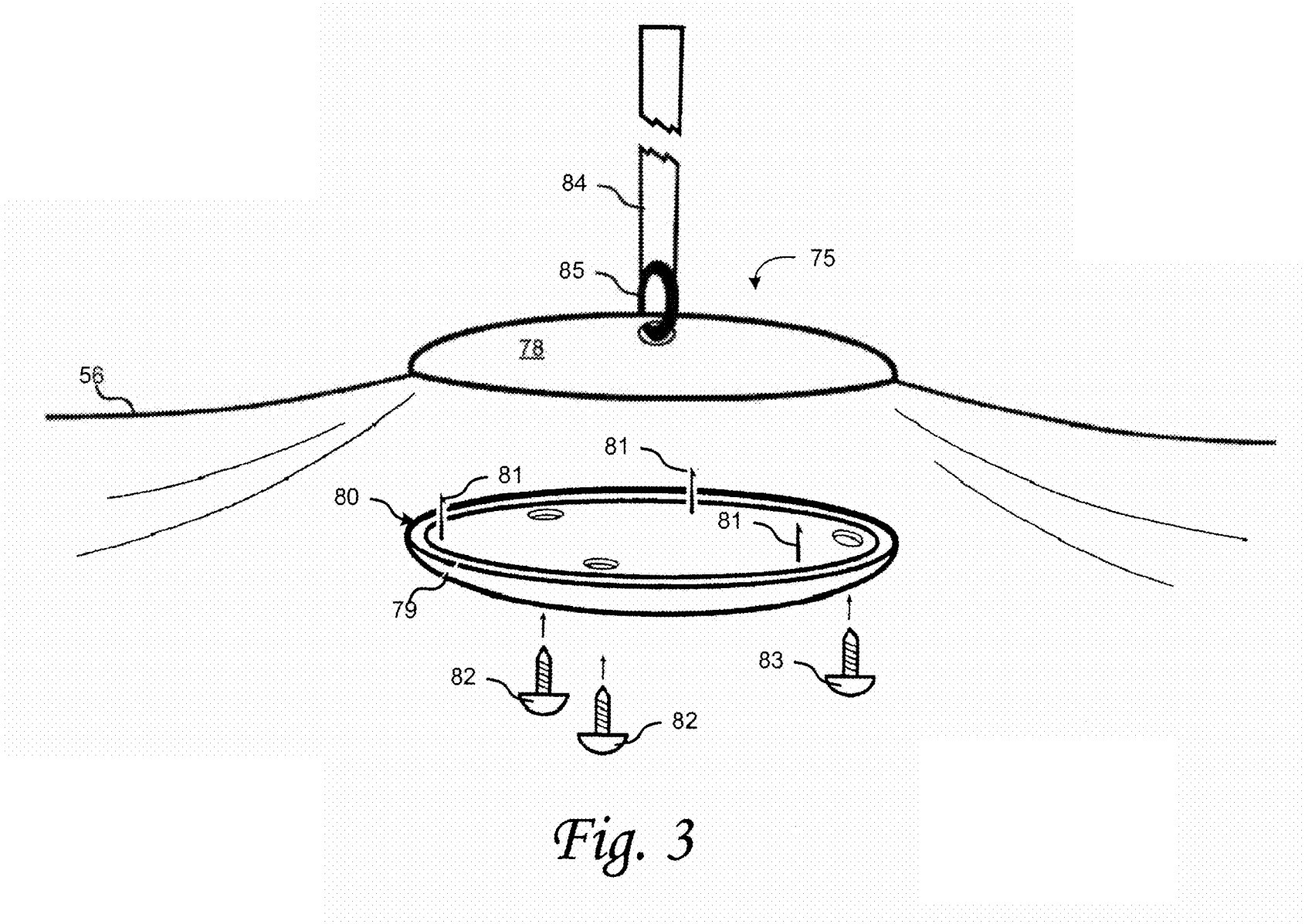
FIG. 3 is an installable attachment member according to an embodiment of the invention.

FIG. 3 illustrates an attachment member installable on a boat cover according to an embodiment of the invention. In some embodiments, an attachment member 75 may be provided to allow a pre-existing boat cover to be retrofitted to allow the boat cover to be suspended from a vertical protrusion. In other embodiments, such an attachment member 75 may be preinstalled on a boat cover during manufacture. In the illustrated embodiment, attachment member 75 comprises a first clamping portion 78 configured to be disposed on an exterior side of boat cover 56 when installed, and further comprises a second clamping portion 79 configured to be disposed on the interior side of boat cover 56 when installed. The first and second clamping portions are secured together using fasteners 82 that pierce the cover 56 at a plurality of openings (not shown).

In some embodiments, one or more seals 80 may be disposed along the perimeter of the clamping portions to distribute the force of attachment along the perimeter of the attachment member. This distribution prevents deformation or ripping that may otherwise be caused to a pre-existing boat cover 56 that was not designed to accommodate such a means of suspension. Furthermore, seal 80 may prevent water from passing through the cover at the openings created by fasteners 82. A variety of seals 80 may be used to accomplish these purposes, for example seal 80 may comprise a rubber gasket or O-ring. The illustrated embodiment further comprises a plurality of guide pins 81 that simplify installation by piercing the cover and fitting into corresponding receptacles to align the first and second clamping portions prior to insertion of the fasteners. In this embodiment, tether 84 is attached to attachment member 75 using a ring or carabiner 85 clipped to first clamping portion 78. As described herein, a clip, buckle, or other means of varying tension may be further provided with tether 84.

Figure 4:
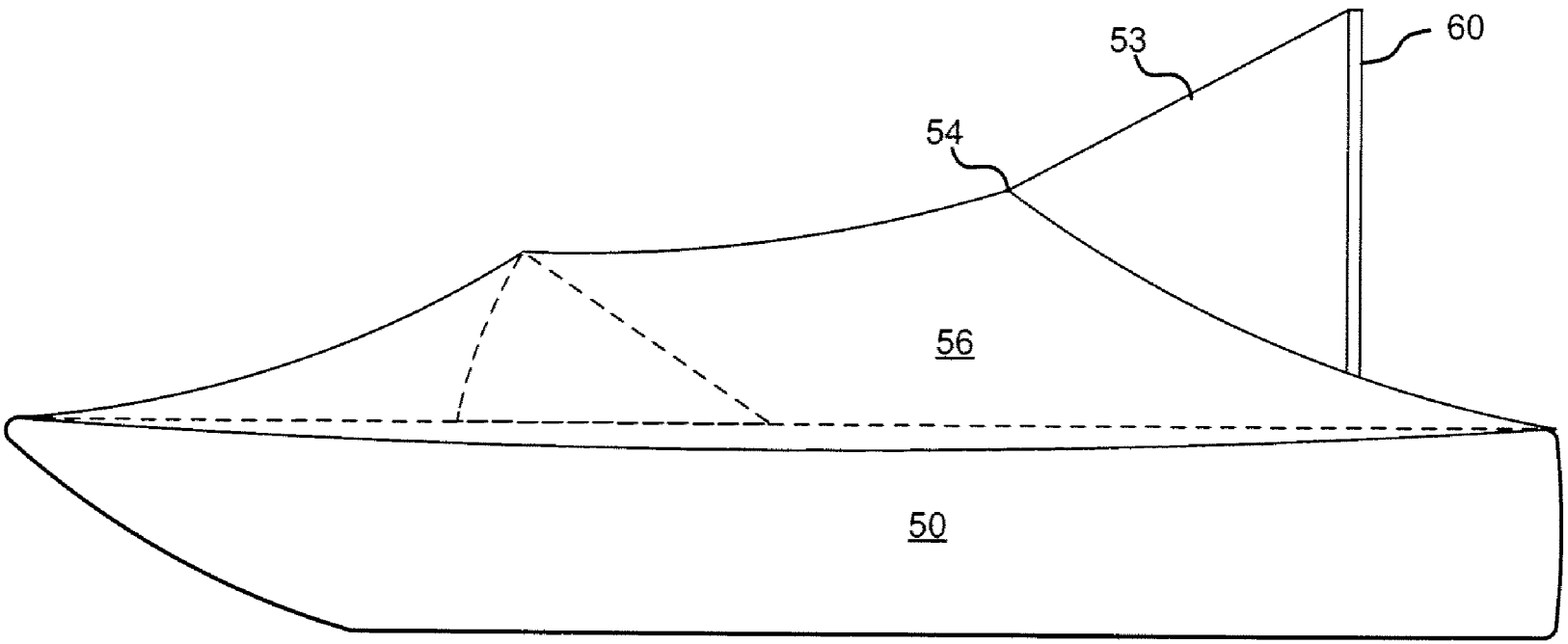
FIG. 4 is a side view of an alternative method of suspending a boat cover according to an embodiment of the invention.

FIG. 4 illustrates a boat cover installed using an alternative vertical projection according to an embodiment of the invention. Although described herein with respect to a wakeboard tower, the present invention attaches readily to any vertical projection arising from boat 50. For example, a water ski pylon 60 may be disposed at the rear of boat 50 and may project above the hull of boat 50. Accordingly, tether 53 may be attached to pylon 60 such that attachment location 54 is suspended above the hull of boat 50, as described herein.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. An installable boat cover suspension device, comprising:

an attachment member configured to attach to a portion of a surface of a boat cover, the attachment member comprising a first clamping member disposed on an exterior side of the portion and secured to a second clamping member disposed on an interior side of the portion; and a tether configured to attach to the attachment member and configured to attach to a vertical projection disposed on a boat;

wherein the tether is configured such that, when the attachment member is installed on the boat cover and when the boat cover is secured to the boat, tension is provided to the portion of the surface of the boat cover to suspend the boat cover above an open area of the boat;

wherein the attachment member is configured to be installed by securing the first clamping member to the second clamping member with the portion between the first and second clamping members, and the attachment member further comprises a fastener configured to secure the first and second clamping members when installed and a gasket configured to distribute force along a perimeter of the attachment member when installed.

2. The boat cover suspension device of claim 1, wherein the attachment member comprises a guide pin configured to pierce the boat cover and enter a corresponding receptacle during installation.

3. The boat cover suspension device of claim 2, wherein the first and second clamping members are substantially disk shaped.

4. The boat cover suspension device of claim 3, wherein the tether further comprises a buckle configured to allow the tension to be adjusted.

5. The boat cover suspension device of claim 4, wherein the boat cover is installable by a user without entering a space created between the boat cover and the boat when the suspension device is installed on the boat cover.

6. The boat cover suspension device of claim 5, wherein the tension may be adjusted to accommodate for stretching of the boat cover.

7. The boat cover suspension device of claim 5, wherein pools of water large enough to plastically deform the boat cover are prevented from forming on the exterior surface of the boat cover when suspension device is installed on the boat cover and when the boat cover is installed on the boat.

8. A method for covering an open area of a boat, comprising:

attaching an attachment member, comprising a first clamping member and a second clamping member, to a boat cover by securing the first clamping member to the second clamping member with a portion of the boat cover held between the first clamping member and the second clamping member;

attaching a tether to a projection disposed on a boat, wherein the tether is attached to the attachment member; and adjusting the tension in the tether to suspend the boat cover above an open area of the boat, wherein the boat cover is installed on the boat by a user without entering a space created between the boat cover and the boat when the suspension device is installed on the boat cover.

9. The method of claim 8, wherein the attachment member further comprises a fastener configured to secure the first and second clamping members when installed.

10. The method of claim 9, wherein the attachment member further comprises a gasket configured to distribute force along a perimeter of the attachment member when installed.

11. The method of claim 10, wherein the attachment member comprises a guide pin configured to pierce the boat cover and enter a corresponding receptacle during installation.

12. The method of claim 8, wherein the first and second clamping members are substantially disk shaped.

13. The method of claim 8, wherein the tether further comprises a buckle.

14. The method of claim 13, wherein the step of adjusting the tension in the tether comprises pulling the tether through the buckle.

* * * * *